United States Patent [19]

Parsons

[11] Patent Number: 4,692,085

[45] Date of Patent: Sep. 8, 1987

[54] MATERIAL HANDLING SYSTEM

[75] Inventor: Michael Parsons, Sudbury, Canada

[73] Assignee: Teledyne Canada Limited, Thornbury, Canada

[21] Appl. No.: 790,131

[22] Filed: Oct. 22, 1985

[30] Foreign Application Priority Data

Feb. 27, 1985 [CA] Canada ..... 475349

[51] Int. Cl.[4] ..... B66F 7/00; B66C 23/72

[52] U.S. Cl. ..... 414/633; 414/719; 414/687; 414/673; 212/195

[58] Field of Search ..... 414/685, 633, 637, 719, 414/687, 673; 212/195

[56] References Cited

U.S. PATENT DOCUMENTS

| | | | |
|---|---|---|---|
| 2,980,271 | 4/1961 | Ulinski | 414/685 X |
| 3,497,095 | 2/1970 | Couberly | 414/719 X |
| 3,536,218 | 10/1970 | Guinot | 414/719 |
| 3,587,882 | 6/1971 | Friday | 414/633 X |
| 4,142,642 | 3/1979 | Myers | 414/719 |
| 4,249,854 | 2/1981 | Teti | 414/685 |
| 4,502,709 | 3/1985 | Schaeff | 414/673 X |

FOREIGN PATENT DOCUMENTS

| | | |
|---|---|---|
| 988058 | 4/1976 | Canada . |
| 1007600 | 3/1977 | Canada . |

*Primary Examiner*—Robert J. Spar
*Assistant Examiner*—Jay I. Alexander
*Attorney, Agent, or Firm*—Ridout & Maybee

[57] ABSTRACT

A vehicle has a steerable subframe articulated to the remainder of the vehicle, a set of lifting forks projecting forwardly from the subframe and supported thereon by a linkage permitting lifting, tilting and lateral movement of the forks, and a counterweight balancing a load carried by the forks across the subframe, the counterweight projecting rearwardly from the subframe beneath the remainder of the vehicle. Interchangeable units are engageable with the forks to transport thereby to a worksite, such as pallet units, a work platform, a crane and a cable dispenser.

10 Claims, 7 Drawing Figures

MATERIAL HANDLING SYSTEM

This invention relates to a material handling system based on a specialized form of fork lift truck.

Fork lift trucks are well known as common components of material handling systems and have been made in various specialized configurations to perform duties in particular environments for which the conventional truck configuration is unsuitable. In general such trucks are intended for use on relatively smooth and level prepared surfaces.

In many operations, service vehicles commonly require to negotiate routes having very steep grades, severe lateral and vertical curvatures, rough and loose surfaces, and restricted clearances, particularly in the vertical direction, whilst carrying heavy loads, in order to bring equipment and supplies to locations where they are required. Clearly conventional fork lift trucks are unsuitable for such an application, and in practice four wheel drive articulated truck chassis have been developed which can negotiate the routes and are fitted with specialized superstructures according to the task to be performed and the clearances available. The resulting vehicles are expensive, and because of their necessarily specialized functions, are commonly underutilized.

The present invention is directed to an adaptation of a four wheel drive articulated truck chassis which provides a high capacity fork lift capability in such a manner as also to render the truck readily adaptable to additional material and equipment handling functions by simply engaged and disengageable add on units, thus enabling a single unit to fulfill any one of a number of functions previously carried out by specialized units, as well as additional functions.

According to the invention, there is provided a vehicle having a chassis, a prime mover, and an operating console, a first set of driven wheels supporting the chassis, a subframe articulated by pivot means in a vertical axis to one end of the chassis by a second set of wheels supporting the subframe, and means to swing said subframe about the pivot to steer the vehicle; wherein a linkage is mounted to said subframe and extends away from the chassis relative to said pivot so as to swing laterally with the subframe, and a counterweight is mounted on the subframe extending in the opposite direction to the linkage so as to swing with the subframe beneath the chassis, the linkage having a rear generally vertically extending link supported or formed by the subframe, a front generally vertically extending link located forwardly of the first set of wheels and supporting lifting fork means, upper and lower longitudinal links extending generally forwardly from pivotal connections to the rear link to upper and lower spaced pivotal connections to said front link, first actuator means operable to cause relative longitudinal displacement of the upper and lower pivotal connections on the front link, whereby to tilt the front link and hence the lifting fork means backward or forward relative to the subframe, and second actuator means operative to swing the front ends of the upper and lower links up and down relative to the subframe whereby to raise and lower the front link and the lifting fork means.

Preferably the lower link is arched upwardly to allow it to be tilted further downward without fouling the subframe. The links will normally be formed by multiple parallel links by fabricated frames. Preferably the upper link incorporates the first actuator means, typically one or more hydraulic rams, so as to tilt the front link by changing the length of the upper link. Preferably the lifting fork means are movable laterally relative to the first link.

With such an arrangement, a load carried by the lifting fork means is to some extent balanced by the counterweight over the further wheel set, which supports the load through the subframe. The load can be swung laterally with the subframe as the vehicle moves to accommodate lateral curvature, and can be tilted up and down and raised or lowered so as to accommodate vertical curvature and limited overhead clearance. The unit can be adapted to different tasks merely by inserting or withdrawing the the lifting fork means into or from sockets in various accessories discussed further below.

In a preferred arrangement, the longitudinal links comprise a lower link assembly arched upwardly relative to the subframe so as to provide an increased range of vertical swinging movement without fouling the subframe, and an upper link assembly incorporating hydraulic actuator means forming the first actuator means and operative to extend and contract the length of the link assembly. The second actuator means are preferably hydraulic actuator means acting between the lower link and the subframe.

Further features of the invention will become apparent from the following description of a preferred embodiment thereof with reference to the accompanying drawings, wherein.

Figure 1:
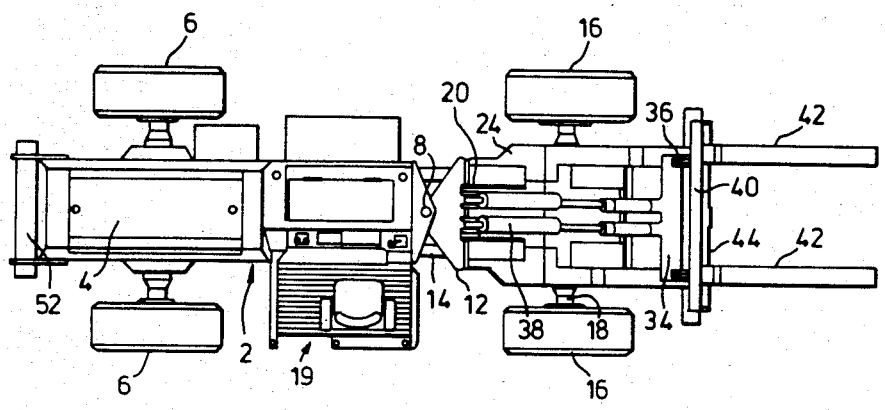
FIG. 1 is a plan view of a vehicle in accordance with the invention.
Figure 2:
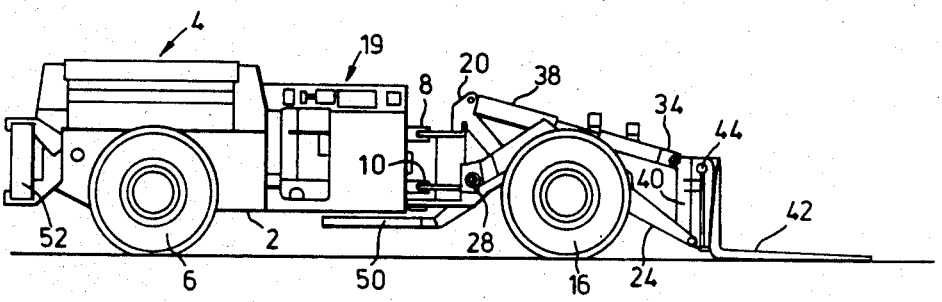
FIG. 2 is a side elevation.
Figure 3:
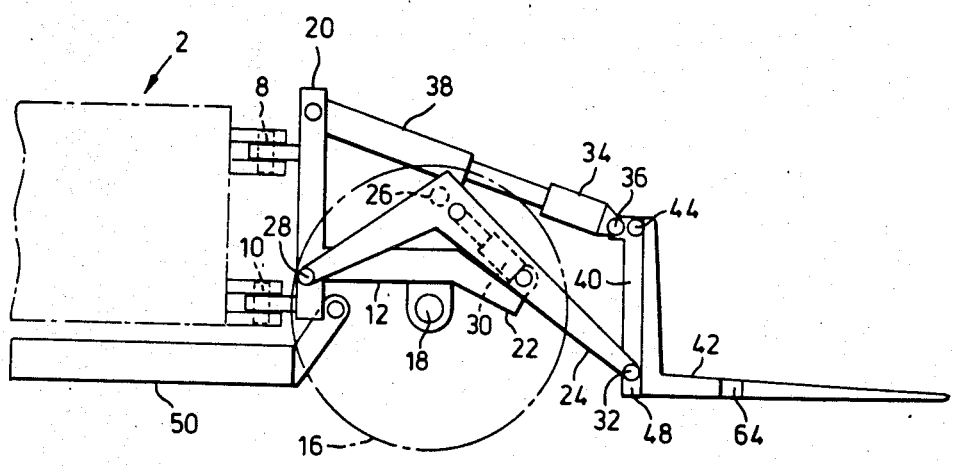
FIG. 3 is a diagrammatic view of the fork lift linkage incorporated in the vehicle.

Referring now to FIGS. 1, 2 and 3, a vehicle in accordance with the invention has a main chassis 2, a prime mover in the form of an internal combustion engine 4 mounted on the chassis, a pair of drive wheels 6 mounted beneath the chassis and linked to the engine by a suitable transmission (not shown). A pair of pivots 8, 10 on a vertical axis connect the front of the chassis to a subframe 12, hydraulic rams 14 acting between the chassis and the subframe to swing the latter relative to the chassis and thus to steer the vehicle through a further pair of drive wheels 16 carried in a driving axle 18 mounted beneath the subframe and connected to the transmission by a propeller shaft (not shown). An operator's console 19 is provided on the chassis. Thus far, apart from features of construction of the subframe described further below, the vehicle is of known type, typified by that manufactured under the designation M60 Minejack (trade mark) Carrier by Eaton Corporation.

The rear of the subframe 12 is extended upwardly at 20 to laterally aligned sets of forks, and forwardly at 22 to further laterally aligned pivot forks ahead of the axle 18. A lower link 8 formed by two laterally spaced upwardly arched arms 24 connected by a cross member 26. The rear ends of the arms are connected by pivot pins 28 to the rear of the subframe. Actuator means in the form of two hydraulic rams 30 act between the first forks at the front of the forward extensions 22 of the subframe and further pivot forks formed forwardly of the cross member 26 so as to raise or lower the lower link relative to the subframe. The arching of the arms 24 extends the downward range of movement of the arms relative to the subframe. The front ends of the arms 24 are formed with pivot forks well ahead of the front wheels, these being connected by pivot pins 32 to the lower side of a laterally oblong rectangular frame 40 forming a front link. The frame extends generally vertically, and is connected at its top side to a fork 34 of an upper link by pivot pins 36. The upper link incorporates actuator means in the form of hydraulic rams 38 connected at their one ends to the fork 34 and at their other ends to the pivot forks of the upward extension 20 of the subframe 12 so that operation of the rams 38 tilts the frame 40 back or forward relative to the subframe.

Two L-shaped lifting forks 42 have the top ends of their stems pivotally and slidably connected to a horizontal bar 44 extending laterally of the frame 40, further actuators (not shown) being provided to move brackets determining the positions of the forks 42 along the bar, so as to assist in positioning the forks in line with sockets in a pallet or other equipment which they are to engage. The bottom ends of the stems of the forks are supported against a lower cross member 48 of the frame 40. Any load supported by the forks is at least partly counterbalanced in seesaw fashion across the axle 18 by a counterweight 50 which is of limited depth but substantial area, and extends from the inner end of the subframe 12 beneath the chassis 2 of the vehicle. The weight of the vehicle chassis itself is balanced across the wheels 6 by a further counterweight 52 at the rear of the chassis. The provision of these counterweights reduces the development of tipping forces which might otherwise destabilize the vehicle when the subframe 12 articulates through a large angle relative to the chassis whilst carrying a heavy load on the lifting forks 42.

As compared to the specialized vehicles built in the past by applying specialized superstructures to the basic vehicle, adaptation of the vehicle for a particular task is in the present instance achieved by engaging one of several interchangeable units with the forks 42.

Figure 4:
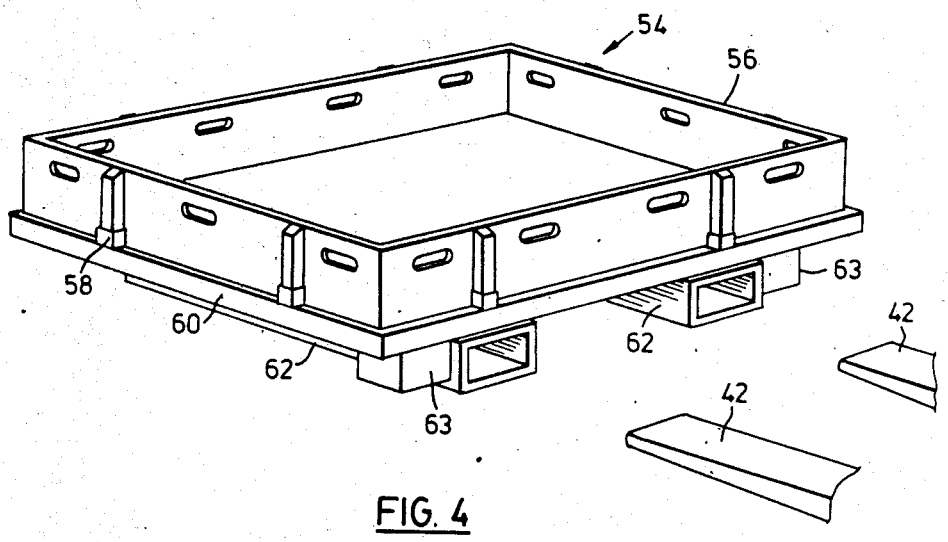
FIG. 4 is a perspective view of a pallet for use with the vehicle.

Referring first to FIG. 4, there is shown a general purpose pallet 54 having removable side walls 56 supported by uprights engaged in sockets 58 at the periphery of a platform 60. The platform 60 has sockets 62 secured to its underside to receive the forks 42, which are locked in position by releasable latches 63 engaging notches 64 in the forks. It will be understood that this basic load carrying pallet may be adapted for specialized purposes by the addition of suitable equipment and superstructure. Thus, it may carry containers and associated equipment for mixing and placing ANFO (ammonium nitrate/fuel oil) explosives, or for providing a lubrication station. Unlike conventional vehicles adapted for such purposes, the vehicle of the invention may convey the specialized pallet to the site where it is to be used and leave it there, releasing the vehicle for some other task.

Figure 5:
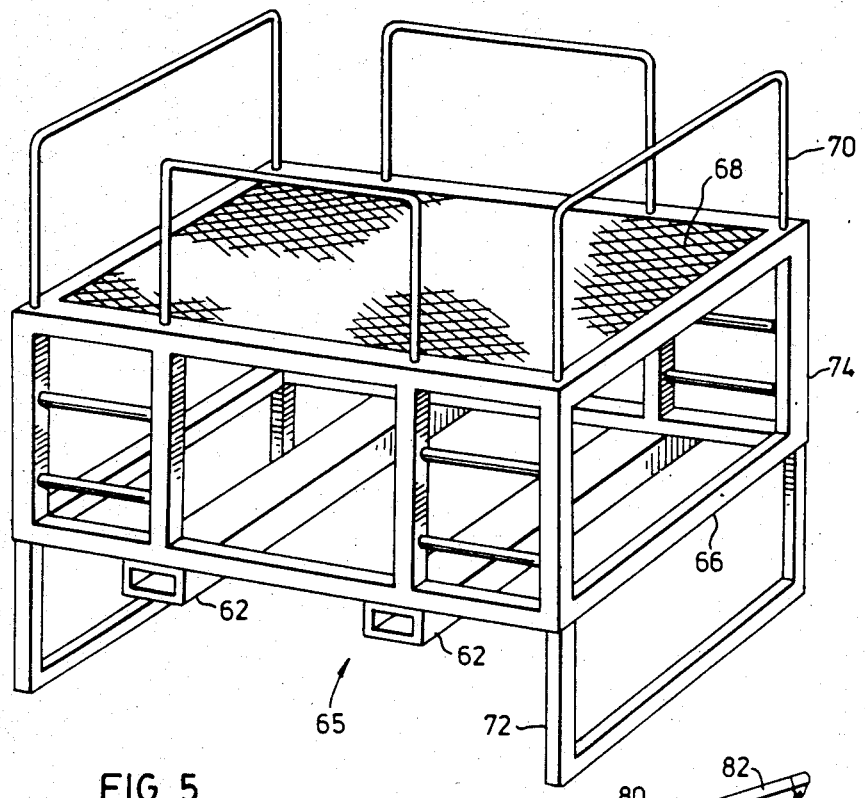
FIG. 5 is a perspective view of a work platform for use with the vehicle.

A further unit is shown in FIG. 5, and forms on location a work platform 65 as shown. The sockets 62 are located beneath a cuboidal frame 66 providing a platform surface 68 and guard rails 70. The height of the frame may be adjusted by lifting it to a desired height, and pinning subframes 72 telescopically received in corner frame members 74 of the unit at a suitable level to maintain the desired height of the platform when the forks of the vehicle are withdrawn from the socket.

Figure 6:
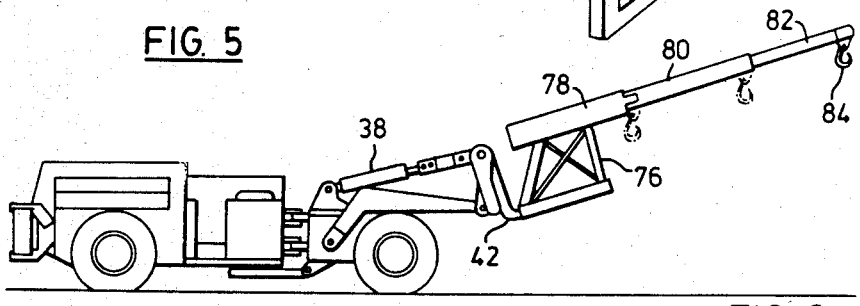
FIG. 6 is a side elevation illustrating operation of a crane attachment applied to the vehicle.

FIG. 6 illustrates a crane unit for use with the vehicle. A frame 76 is engaged with the forks 42 and supports a first boom section 78. A second boom section 80 is hinged to the first section so that it can be moved between an extended position as shown and a folded position alongside the section 78. A third section 82 is telescopically received within the second section 80 from which it can be extended by a hydraulic ram operated from the hydraulic system of the vehicle. The crane hook 84 can be positioned using the rams 14, 30 and 38.

Figure 7:
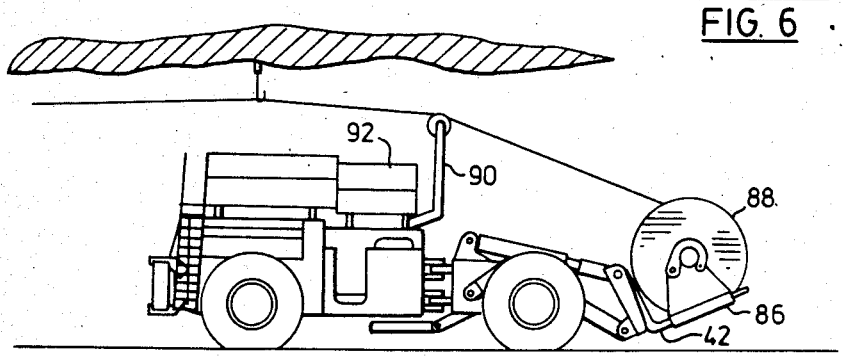
FIG. 7 illustrates a cable stringing attachment applied to the vehicle.

FIG. 7 illustrates the vehicle adapted for stringing cables. A cable drum carrier 86 is fitted to the forks 42, and cable from a drum or drums 88 passes over a guide 90 on platform 92 supported on the vehicle.

In each case the rams 14, 30 and 38 can be utilized not only to position for use equipment carried on the forks 42, but also reposition the load on the forks during transit to enable the vehicle and its load to negotiate sharp horizontal and vertical curvature and limited clearances, whilst the counterweights 50 and 52 allow this to be achieved without applying excessive tilting forces to the vehicle.

Whilst this description has assumed for convenience that the forks are at the front of the vehicle, it will be appreciated that this designation is to some extent arbitrary since the vehicle may move in either direction.

I claim:

1. A vehicle having a chassis, a prime mover, and an operating console, a first set of driven wheels supporting the chassis, a subframe articulated by pivot means in a vertical axis to one end of the chassis by a second set of wheels supporting the subframe, and means to swing said subframe about the pivot to steer the vehicle; wherein a linkage is mounted to said subframe and extends away from the chassis relative to said pivot so as to swing laterally with the subframe, and a counterweight is mounted on the subframe extending in the opposite direction to the linkage so as to swing with the subframe beneath the chassis, the linkage having a rear generally vertically extending link supported or formed by the subframe, a front generally vertically extending link located forwardly of the second set of wheels and supporting lifting fork means, upper and lower longitudinal links extending generally forwardly from pivotal connections to the rear link to upper and lower spaced pivotal connections to said front link, first actuator means operable to cause relative longitudinal displacement of the upper and lower pivotal connections on the front link, whereby to tilt the front link and hence the lifting fork means backward or forward relative to the subframe, and second actuator means operative to swing the front ends of the upper and lower links up and down relative to the subframe whereby to raise and lower the front link and the lifting fork means.

2. A vehicle according to claim 1, wherein the lower longitudinal link is arched upwardly above the second set of wheels whereby it may be tilted further downwardly without fouling the subframe.

3. A vehicle according to claim 1, wherein the upper link incorporates hydraulic actuator means whereby its length may be changed.

4. A vehicle according to claim 1, incorporating means to move the lifting forks laterally relative to the front link.

5. A vehicle according to claim 1, incorporating a pallet releasably locked to the lifting forks.

6. A vehicle according to claim 1, incorporating a crane unit releasably locked to the lifting forks.

7. A vehicle according to claim 1, incorporating a cable dispenser unit releasably locked to the lifting forks.

8. A vehicle according to claim 1, incorporating a work platform releasably locked to the lifting forks.

9. A vehicle according to claim 1, incorporating a work platform releasably locked to the lifting forks and having telescoping support frames to support it independently of said forks.

10. A vehicle according to claim 1, including a further counterweight at the opposite end of the chassis from the subframe.

* * * * *